US006044816A

United States Patent [19]

Buck et al.

[11] Patent Number: 6,044,816

[45] Date of Patent: Apr. 4, 2000

[54] VARIABLE VALVE CONTROL FOR AN INTERNAL COMBUSTION ENGINE

[75] Inventors: Walter Buck, Ludwigsburg; Roland Schwegler, Weinstadt, both of Germany

[73] Assignee: DaimlerChrysler AG, Stuttgart, Germany

[21] Appl. No.: 09/173,390

[22] Filed: Oct. 15, 1998

[30] Foreign Application Priority Data

Oct. 24, 1997 [DE] Germany ..... 197 47 035

[51] Int. Cl.[7] ..... F01L 1/04; F01L 1/34

[52] U.S. Cl. ..... 123/90.17; 123/90.27; 123/90.31; 123/193.3

[58] Field of Search ..... 123/90.15, 90.16, 123/90.17, 90.27, 90.31, 193.5, 193.3

[56] References Cited

U.S. PATENT DOCUMENTS

| | | | |
|---|---|---|---|
| 4,535,733 | 8/1985 | Honda | 123/90.17 |
| 4,546,735 | 10/1985 | O'Neal | 123/90.17 |
| 4,862,845 | 9/1989 | Butterfield et al. | 123/90.15 |
| 4,976,229 | 12/1990 | Charles | 123/90.17 |
| 4,986,801 | 1/1991 | Ohlendorf et al. | 123/90.17 |
| 5,052,350 | 10/1991 | King | 123/90.16 |
| 5,178,105 | 1/1993 | Norris | 123/90.15 |
| 5,431,132 | 7/1995 | Kreuter et al. | 123/90.16 |
| 5,540,197 | 7/1996 | Golovatai-Schmidt et al. | 123/90.17 |
| 5,555,860 | 9/1996 | Wride | 123/90.16 |
| 5,586,527 | 12/1996 | Kreuter | 123/90.15 |
| 5,592,906 | 1/1997 | Kreuter et al. | 123/90.16 |
| 5,680,837 | 10/1997 | Pierik | 123/90.17 |

FOREIGN PATENT DOCUMENTS

| | | |
|---|---|---|
| 0 202 682 | 11/1986 | European Pat. Off. . |
| 0 732 483 | 9/1996 | European Pat. Off. . |
| 42 44 550 | 7/1994 | Germany . |
| 195 21 004 | 12/1996 | Germany . |
| 197 01 203 | 7/1998 | Germany . |

*Primary Examiner*—Weilun Lo
*Attorney, Agent, or Firm*—Klaus J. Bach

[57] ABSTRACT

In a variable control arrangement in an internal combustion engine including intake and exhaust valves, a valve operating mechanism with a first camshaft controlling the intake valve opening times and a second camshaft controlling the intake valve closing times, a four gear coupler drive mounted on the first and second camshafts for controlling their relative angular positions, a control wheel supported coaxially with one of the camshafts and connected to the coupler drive for adjusting the relative angular position of the first and second camshafts, and a control arrangement including a control motor for operating the control wheel, the coupler drive with the control wheel and the valve operating mechanism are combined in a camshaft bearing housing assembly which is mounted on the cylinder head.

7 Claims, 4 Drawing Sheets

VARIABLE VALVE CONTROL FOR AN INTERNAL COMBUSTION ENGINE

BACKGROUND OF THE INVENTION

The invention relates to a variable valve control arrangement for an internal combustion engine having a valve operating mechanism including two camshafts whose angular position relative to each other is controllable by a four-gear coupler drive which is disposed in the drive connection between the two camshafts and which is controllable by a control arrangement including a control motor and a control gear arranged co-axially with one of the camshafts and operable by the control motor by way of a drive pinion.

Variable valve controls of this type are known for example from DE 42 44 550 A1 and from DE 195 21 004. They are used particularly for a throttle-free control of gasoline engines by changing the opening rates and opening times of the intake valves. Basically, such valve controls include two camshafts which rotate in opposite directions and which actuate, by way of their cams, together the rocker arm for a spring-loaded intake valve. One of the camshafts takes on the valve opening function while the other has the valve closing function so that, with a relative rotation between the two camshafts, the valve lift and the valve opening period are controllable over a wide range.

The relative rotation between the two camshafts is obtained by way of a four-gear coupler drive whose input gear is connected to a first camshaft which is driven by the crankshaft and whose output gear is connected to the second camshaft which is driven by the coupler drive so as to be rotatable relative to the first camshaft. The input gear and the output gear are each in engagement with intermediate gears and the intermediate gears are in engagement with each other. The input gear, the output gear and the intermediate gears are interconnected by coupler members such that the intermediate gears roll off the input and output gears when the coupler members are pivoted. In this way, by pivoting of the coupler drive by means of a control member, which is pivotable about the axis of the input or the output gear and which is connected to the respective coupler member, the two camshafts can be rotated relative to each other. The control member is operated by a control motor and the control arrangement formed by the control member and the control motor provides for a sensitive adjustment control of the coupler drive. As a result, the load can be controlled in a correspondingly sensitive manner.

Variable valve controls of this type are relatively complex and therefore their basic setting is not easily adjustable since, in addition to the camshaft drive, a control arrangement with a separate drive including a control motor is required.

It is the object of the present invention to provide such a variable valve control which is easy to install and to adjust and which furthermore takes up only a relatively small space.

SUMMARY OF THE INVENTION

In a variable control arrangement in an internal combustion engine including intake and exhaust valves, a valve operating mechanism with a first camshaft controlling the intake valve opening times and a second camshaft controlling the intake valve closing times, a four gear coupler drive mounted on the first and second camshafts for controlling their relative angular positions, a control wheel supported coaxially with one of the camshafts and connected to the coupler drive for adjusting the relative angular position of the first and second camshafts and a control arrangement including a control motor for operating the control wheel, the coupler drive with the control wheel and the valve operating mechanism are combined in a camshaft bearing housing assembly which is mounted on the cylinder head.

With such an arrangement, the coupler drive can be preadjusted and connected to the camshafts which are also adapted to be properly connected to the coupler drive so that the engine assembly procedure is not detrimentally affected by the additional equipment to be installed particularly if appropriate rapid mounting devices such as plug-in connections are used.

In a preferred embodiment, the mounting unit includes also the control for the variably controllable valves, that is, generally, be intake valves. In this case, the mounting unit can be combined with a camshaft bearing housing which includes the variable valve control for the respective valves and the coupler drive and which can be mounted onto the cylinder head as a preassembled unit.

This is facilitated particularly by the fact that the bearing housing includes a sidewardly extending projection for supporting the drive pinion of the control motor. The arrangement results in a particularly advantageous total configuration if the coupler drive is arranged at the front end in a front extension of the camshaft bearing housing and the control gear is disposed adjacent the camshaft which is next to the housing projection. Then the drive pinion may be disposed at the side of the bearing housing where it can be accommodated within a small space.

With the present invention, the space requirements can be met in a particularly suitable manner by a balcony-like side projection of the cylinder head bottom part on which the camshaft bearing housing is disposed. A control motor is preferably mounted on this projection whereby it can be easily connected to the pre-assembled coupler drive disposed in the camshaft bearing housing.

Further embodiments and features of the invention will become apparent from the following description on the basis of the accompanying drawings.

DESCRIPTION OF A PREFERRED EMBODIMENT

Figure 1:
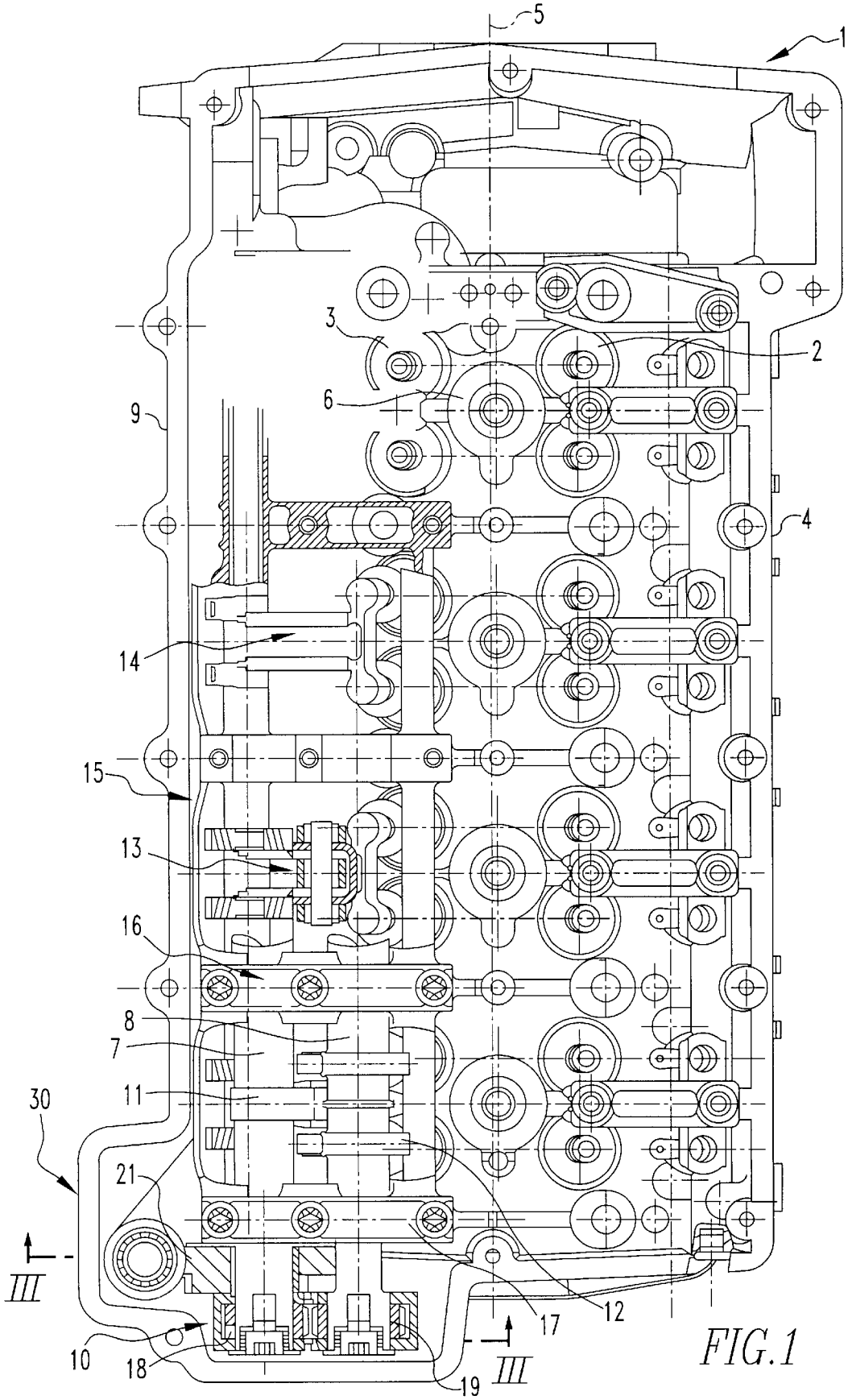
FIG. 1 is a top view of a cylinder head of an internal combustion engine which has four valves per cylinder and whose intake valves are adjustable with regard to valve lift and valve opening duration.
Figure 2:
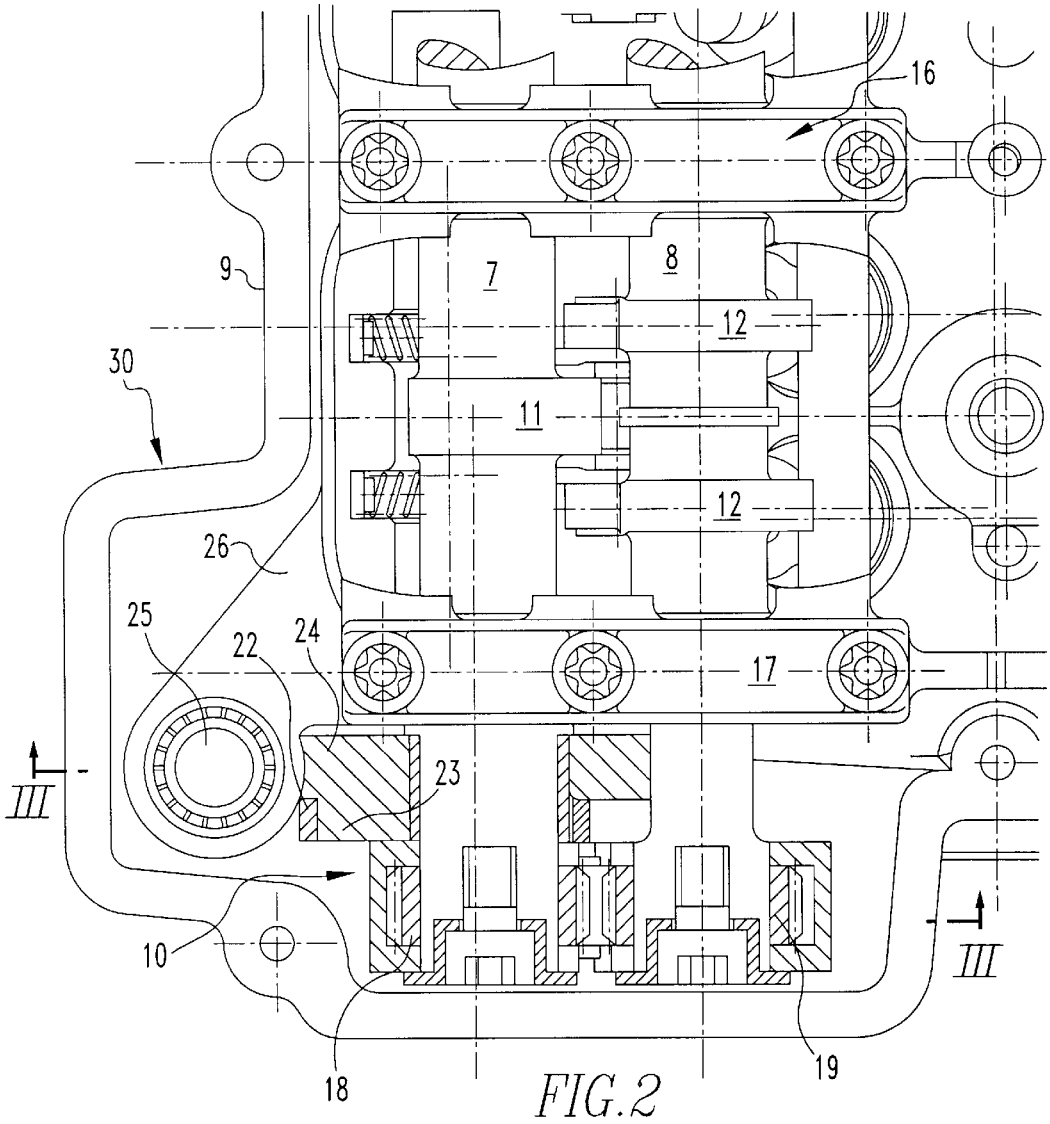
FIG. 2 is an enlarged top view of an end portion of the cylinder head shown in FIG. 1.

FIG. 1 is a top view of a cylinder head 1, with the cylinder head cover removed, of a four cylinder internal combustion engine having four valves for each of the four cylinders, that is, two exhaust valves 2 and two intake valves 3. The control for the exhaust valves will not be described as the exhaust valves are controlled in a conventional manner by way of a camshaft which is not shown but which, in a top view, is disposed between the exhaust valves 2 and the adjacent exhaust side 4 of the cylinder head 1. With respect to the longitudinal center-plane 5 of the cylinder head 1 along which wells 6 are arranged for the reception of spark plugs are fuel injection elements, the exhaust valves 2 and the intake valves 3 are arranged opposite each other. The intake valves can be operated with variable lift and variable opening duration by two camshafts 7 and 8.

The variable valve control employed herein is known in principle from the assignee's U.S. patent application Ser. No. 09/007,563 filed Jan. 15, 1998, now U.S. Pat. No. 5,931,127, which is made part of the specification by reference thereto so that a detailed explanation of the operation of such a variable valve control is not necessary. In accordance with this principle, the camshaft 7 which is disposed adjacent the intake side 9 of the cylinder head is driven by the crankshaft and itself drives the camshaft 8 by way of a control drive 10, which is a four-gear coupler drive. The camshafts 7 and 8 of which the camshaft 7 controls the opening times of the intake valves 3 and the camshaft 8 controls the closing times of the intake valves 3 together with their cams 11, 12 actuate a rocker arm 14 by way of engagement members formed by rollers 13.

The camshafts 7 and 8 and the respective operating mechanisms for the valves are combined so as to form, with the bearing structure, a camshaft bearing housing 15 which can be preassembled. The camshaft bearing housing 15 includes bearing blocks 16 arranged between the cylinders and at the ends of the cylinder head, the camshaft bearing housing 15 being bolted onto the cylinder head 1 by bolts extending through the bearing blocks 15.

The camshafts 7 and 8 have free ends projecting beyond the bearing block 17 at one end of the cylinderhead and carry a drive gear 18 and a driven gear 19 respectively, of the four gear coupler drive 10 by way of which the relative angle of rotation of the two camshafts 7, 8 can be changed. For changing the position of the two camshafts relative to each other the coupler drive 10 includes a control wheel 21 which is rotatably supported on the bearing housing 17 co-axially with the camshaft 7, and by way of which the coupling arms of the coupler drive 10 can be pivoted about the axes of the camshafts 7 and 8. By pivoting the coupler arms, the angular positions of the camshaft 7 and 8 relative to each other can be changed for controlling lift and opening duration of the intake valves 3.

Figure 3:
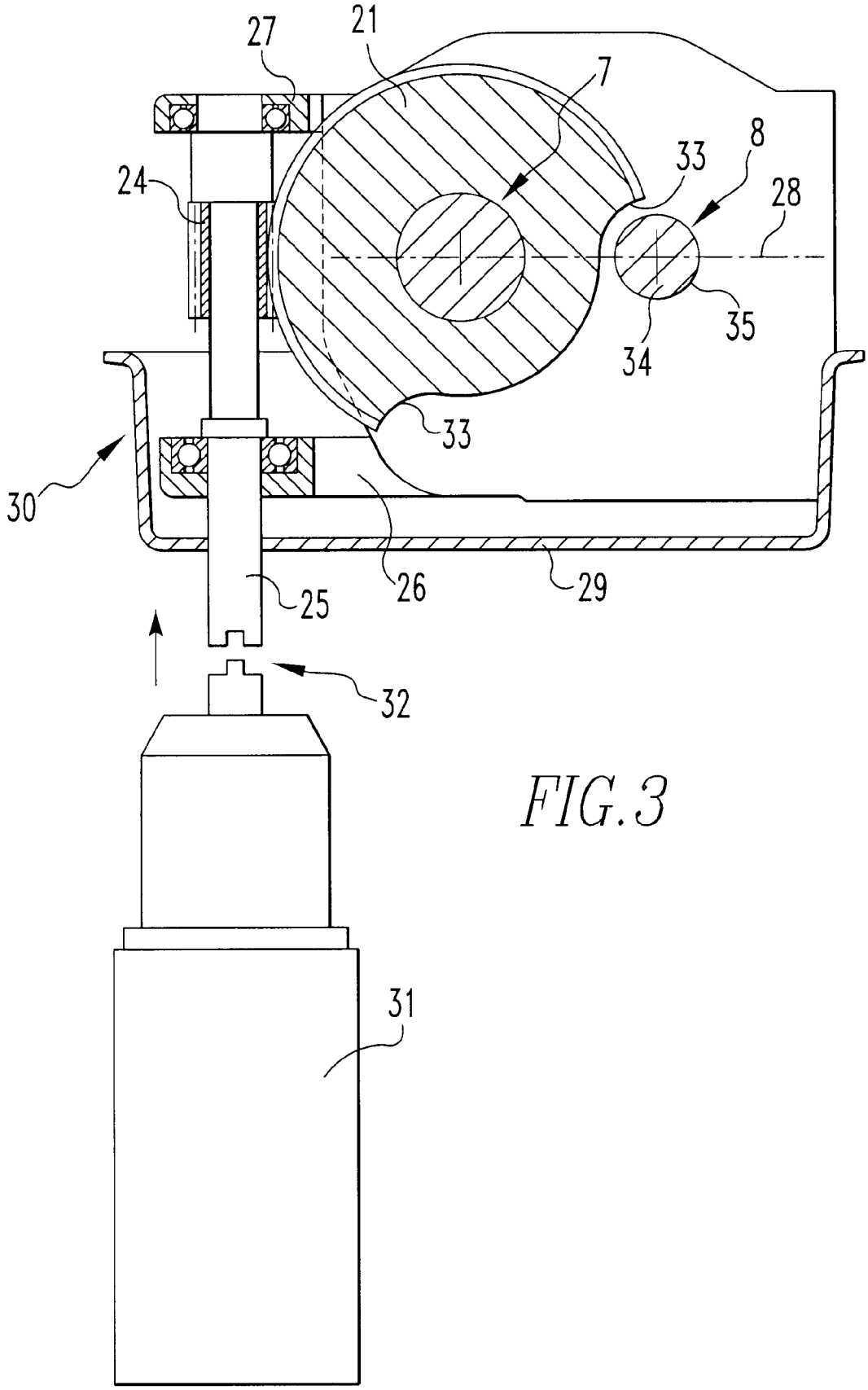
FIG. 3 is a cross-sectional view showing the drive arrangement for a coupler drive, the cross-section being taken along line III—III as indicated in FIG. 1 and in FIG. 2.

The control wheel 21 disposed axially between the coupler drive 10 and the end bearing block 17 is connected to a coupler arm in a way not shown in detail by a connecting rod 22 which is supported on an eccentric collar 23 of the control wheel 21. The control wheel 21 includes a worm gear structure in engagement with a worm 24 as shown in FIG. 3 for rotating the control wheel 21. The worm 24 is mounted on a shaft 25 which is supported in side projections 26, 27 of the bearing housing 15. The side projection 26, 27 are spaced from each other and the worm 24 is disposed in an area of the dividing plane 28 of the bearing block 16 of the camshaft bearing housing 17. Axially, the projections 26 and 27 extend from the end of the bearing housing adjacent the bearing block 17 beyond the bearing block 17 thereby forming a side extension of the bearing housing in such a way that the axis of rotation of the shaft 25 and of the worm 24 are disposed in a radial plane extending through the control wheel 21 and the worm 24 is in engagement with the worm gear structure on the control wheel 21.

Because of the arrangement of the camshaft bearing housing 15 closely adjacent the intake side, the projections 26 and 27 are provided adjacent the cylinder head with a balcony-like extension 30 which, as schematically shown in FIG. 3 is limited downwardly by the outwardly projecting bottom wall 29 of the cylinder head. With the balcony-like extension 30 of the cylinder head formed in this manner, the shaft 25 of the worm 24 can extend downwardly through the bottom wall 29 of the cylinder head to the outside of the engine block so that a control motor 31 can be easily connected to the end of the shaft 25 below the cylinder head 1. The control motor 31 can be connected to the shaft 25 by an appropriate coupling device, particularly a rapid-connect coupling which may also tolerate a certain axial misalignment. The coupling device is indicated symbolically by the structure 32. The control motor 31 may be mounted onto the engine block which is not shown, but on which the cylinder head 1 is mounted. It is however preferred if the control motor 31 is mounted to the extension 30 for example by way of a support structure which is not shown in the figure.

Figure 4:
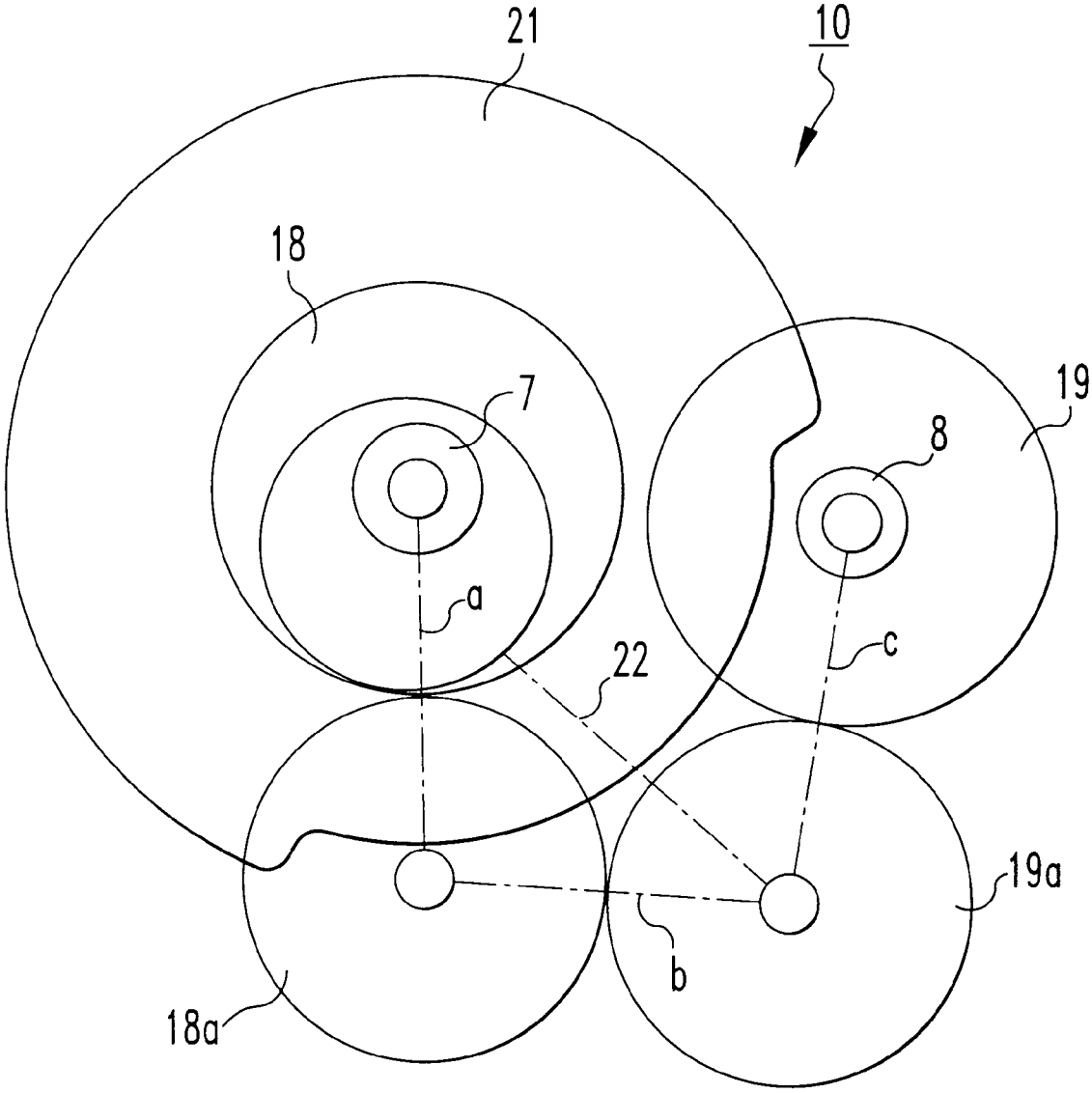
FIG. 4 shows schematically the coupler drive.

FIG. 4 shows the coupler drive 10 schematically. The drive includes the gears 18 19, mounted on the first and second camshafts 7 and 8, and two transfer gears 18*a* and 19*a* which are supported by coupler links a, b, c such that they are held in meshing engagement with the gears 18, and 19, respectively, and with each other. The linkage can be pivoted by a connecting rod 22 which eccentrically supported on the control wheel 21 and connected to the jointure of the links b and c so that the linkage can be pivoted when the control wheel 21 is rotated for controlling the relative angular positions of the first and second camshaft.

The control wheel 21 can be rotated by the control motor 31 by way of the worm 24 about the axis of the camshaft 7. The control wheel's gear structure extends only over part of its circumference; the remainder of the control wheel has a reduced radius. The reduced radius area provides for flank structures 33 on the control wheel 21 which form stops engaging the camshaft 8 in a reduced-diameter area 34 thereof, the camshaft 8 forming an opposite stop member 35. In this way, the control movement of the control wheel is limited in both directions of rotation which facilitates to provide well defined end positions for the control motor which may be mounted after assembly of the unit.

The control motor 21 may of course also be arranged in a position with angles different from that shown in FIG. 3 with appropriately adapted gear structures so that the control motor can be mounted under different installation conditions without departing from the inventive principle. As shown, the control motor 31, that is, the axis of the worm extends normal to the 1bottom wall of the cylinder head 1 or a plane including the axes of rotation of the camshafts 7 and 8 which plane is parallel to the bottom wall of the cylinder head 1.

In FIG. 3, the penetration of the shaft 25 through the bottom wall 29 of the cylinder head 1 in the area of the extensions 30 is shown only schematically and for example no seals are shown in the schematic representation.

What is claimed is:

1. A variable valve control arrangement in an internal combustion engine including intake and exhaust valves, a valve operating mechanism with first and second camshafts, a camshaft drive arrangement including a four-gear coupler drive for changing the angular position of said two shafts relative to each other, said first camshaft controlling the opening of said intake valves and said second camshaft controlling the closing of said intake valves, a control wheel rotatably supported co-axially with one of said camshafts and connected to said coupler drive for adjusting the relative angular positions of said camshafts and a control arrangement including a control motor for operating said control wheel, said coupler drive with said control wheel and drive means for said control wheel for controlling the relative position of the camshafts and also said valve operating mechanism being combined in a camshaft bearing housing assembly mounted onto said cylinder head, said bearing housing assembly having a sidewardly extending projection and said control wheel drive means including a drive gear in engagement with said control wheel and mounted in said sideward extension for driving said control wheel.

2. A valve control arrangement according to claim 1, wherein said coupler drive is arranged at one end of said camshaft bearing housing adjacent to, and spaced from, a camshaft bearing disposed at one end thereof and said control wheel is disposed between said camshaft bearing and said coupler drive.

3. A valve control arrangement according to claim 2, wherein said sideward projection is disposed at one end of said bearing housing where said coupler drive is arranged.

4. A valve control arrangement according to claim 2, wherein said bearing housing has two spaced sidewardly extending projections between which said drive gear is arranged.

5. A valve control arrangement according to claim 4, wherein said sideward projections are disposed on top of one another and said drive gear is mounted on a shaft rotatably supported by said sideward projections.

6. A valve control arrangement according to claim 5, wherein said cylinder head has, in the area adjacent the coupler drive, an extension around the sideward projection with a bottom wall forming a balcony-like structure and the drive gear is mounted on a drive shaft extending through the bottom wall.

7. A valve control arrangement according to claim 5, wherein said control motor is disposed below said balcony-like structure of said cylinder head and is coupled to said drive shaft.

* * * * *